US007536988B2

(12) United States Patent
Nishiyama

(10) Patent No.: US 7,536,988 B2
(45) Date of Patent: May 26, 2009

(54) CYLINDER HEAD AND INTERNAL COMBUSTION ENGINE HAVING THE SAME

(75) Inventor: Koji Nishiyama, Nagoya (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 0 days.

(21) Appl. No.: 12/022,605

(22) Filed: Jan. 30, 2008

(65) Prior Publication Data

US 2008/0184957 A1 Aug. 7, 2008

(30) Foreign Application Priority Data

Feb. 1, 2007 (JP) ..... 2007-023031

(51) Int. Cl.
*F02F 1/42* (2006.01)

(52) U.S. Cl. ..... 123/193.5; 123/193.1; 123/41.17; 123/41.82 R; 123/41.85

(58) Field of Classification Search ..... 123/193.5, 123/41.01, 41.17, 41.34, 41.82 R, 41.85, 123/193.1; 92/169.1, 172
See application file for complete search history.

(56) References Cited

U.S. PATENT DOCUMENTS 4,641,609 A * 2/1987 Tanaka ..... 123/41.82 R
5,535,714 A * 7/1996 Aoyama et al. ..... 123/193.5
5,845,616 A * 12/1998 Schwarzenthal et al. . 123/90.33
5,957,104 A * 9/1999 Ohsawa ..... 123/193.5
6,557,522 B2 * 5/2003 Diel et al. ..... 123/305
6,601,558 B2 * 8/2003 Clements ..... 123/193.5
6,622,686 B2 * 9/2003 Komatsuda et al. ..... 123/193.5
6,691,663 B2 * 2/2004 Tsukui et al. ..... 123/188.9
6,981,473 B2 * 1/2006 Gunji et al. ..... 123/41.82 R
7,089,906 B2 * 8/2006 Tsukui et al. ..... 123/198 F
2005/0205024 A1 * 9/2005 Yamada ..... 123/41.82 R

FOREIGN PATENT DOCUMENTS

JP 2523326 B 12/1988

* cited by examiner

*Primary Examiner*—Stephen K Cronin
*Assistant Examiner*—David Hamaoui
(74) *Attorney, Agent, or Firm*—Global IP Counselors, LLP

(57) ABSTRACT

A cylinder head includes a lifter guide boss part, a concave relief groove portion and a guide portion. The lifter guide boss part defines a lifter bore arranged to slidably support a valve lifter. The concave relief groove portion has a predetermined width and a predetermined depth formed on the lifter guide boss part in a position corresponding to a rotation direction of a cam to avoid an interference between the cam and the lifter guide boss part. The relief groove portion includes a pair of groove side surfaces and a groove bottom surface with a pair of corner sections being formed between the groove bottom surface and the side groove surfaces. The guide portion protrudes from the groove bottom surface in a sliding direction of the valve lifter to slidably guide the valve lifter. The guide portion is spaced apart from the corner sections of the relief groove portion.

12 Claims, 8 Drawing Sheets

CYLINDER HEAD AND INTERNAL COMBUSTION ENGINE HAVING THE SAME

CROSS-REFERENCE TO RELATED APPLICATIONS

This application claims priority to Japanese Patent Application No. 2007-023031, filed on Feb. 1, 2007. The entire disclosure of Japanese Patent Application No. 2007-023031 is hereby incorporated herein by reference.

BACKGROUND OF THE INVENTION

1. Field of the Invention

The present invention relates to a cylinder head and an internal combustion engine having the same.

2. Background Information

Japanese Patent No. 2523326 discloses a conventional cylinder head that includes a valve lifter guide boss forming a bore for supporting a valve lifter therein. In such a conventional cylinder head, a portion of the valve lifter guide boss corresponding to the rotational direction of a cam, which periodically pushes down the valve lifter, is cut out to prevent the cam and the valve lifter guide boss from interfering with each other.

In view of the above, it will be apparent to those skilled in the art from this disclosure that there exists a need for an improved cylinder head. This invention addresses this need in the art as well as other needs, which will become apparent to those skilled in the art from this disclosure.

SUMMARY OF THE INVENTION

In the conventional cylinder head described in the above-mentioned publication, a sliding length of the valve lifter within the valve lifter guide boss decreases in the cam rotational direction by the amount that the valve lifter guide boss is cut out. Therefore, the sliding orientation of the valve lifter may become unstable. Although the sliding orientation of the valve lifter may be stabilized by improving dimensional precision of the valve lifter and the valve lifter guide boss to reduce the clearance therebetween, improving the dimensional precision leads to an increase in cost.

Accordingly, one object of the present invention is to provide a cylinder head that can easily ensure the stability of the sliding orientation of the valve lifter while suppressing an increase in cost. Another object of the present invention is to provide an internal combustion engine that can reduce noise resulting from a rattling sound of the valve lifter.

In order to achieve the above objects of the present invention, a cylinder head includes a lifter guide boss part, a concave relief groove portion and a guide portion. The lifter guide boss part defines a lifter bore configured and arranged to slidably support a valve lifter that is periodically pushed down by a cam that rotates in accordance with a rotation of a camshaft. The concave relief groove portion has a predetermined width and a predetermined depth formed on the lifter guide boss part in a position corresponding to a rotation direction of the cam to avoid an interference between the cam and the lifter guide boss part due to a rotation of the cam. The relief groove portion includes a pair of groove side surfaces and a groove bottom surface with a pair of corner sections being formed between the groove bottom surface and the side groove surfaces. The guide portion protrudes from the groove bottom surface of the relief groove portion in a sliding direction of the valve lifter to slidably guide the valve lifter. The guide portion is spaced apart from the corner sections of the relief groove portion.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
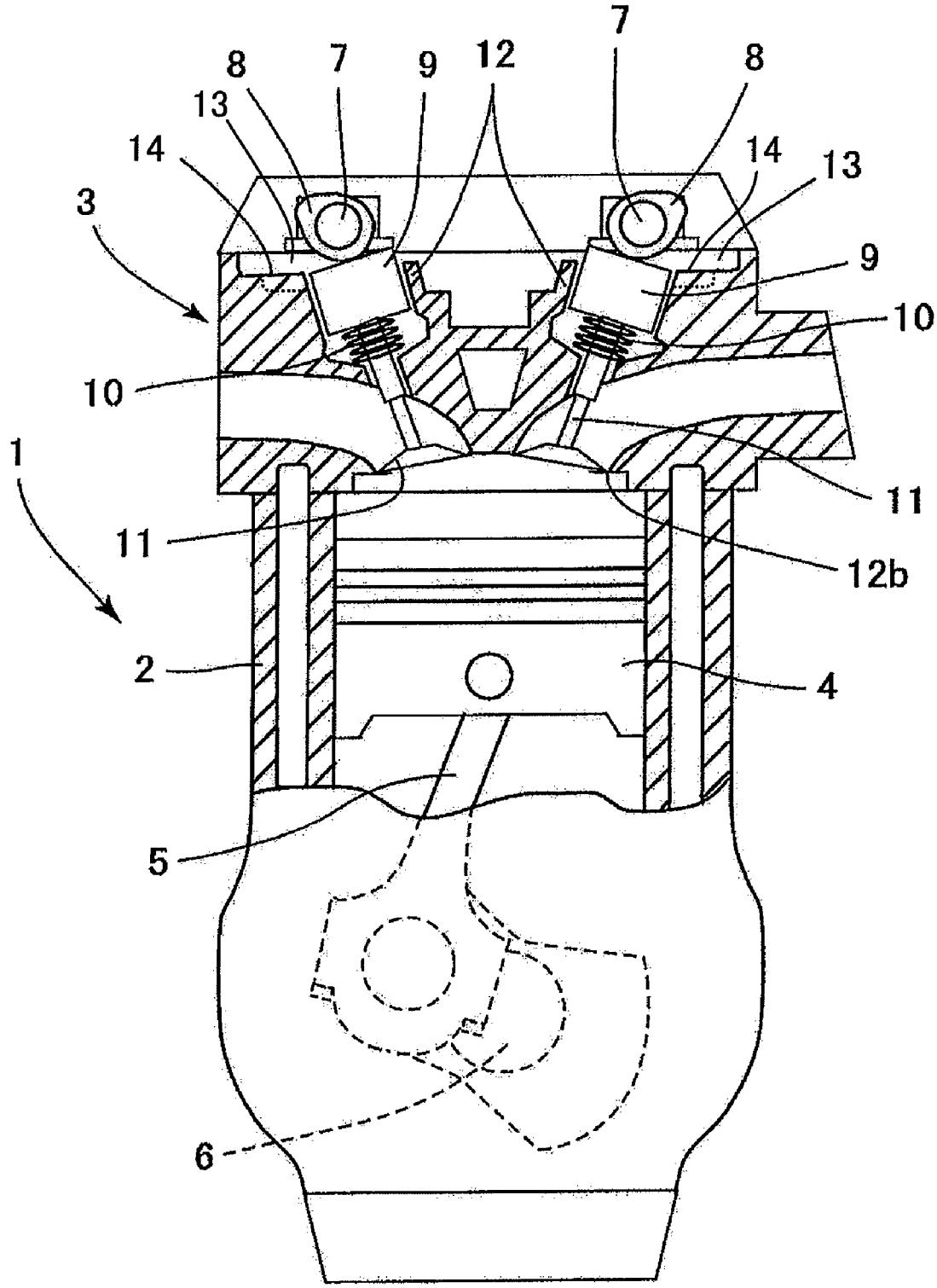
FIG. 1 is a simplified vertical cross sectional view of an internal combustion engine in accordance with a first embodiment of the present invention.

Referring initially to FIG. 1, an internal combustion engine 1 is illustrated in accordance with a first embodiment. FIG. 1 is a simplified vertical cross sectional view of the engine 1. In the first embodiment, the engine 1 is illustrated by using an example of a four-cylinder engine. As shown in FIG. 1, the engine 1 includes a cylinder block 2 defining a plurality of cylinders (only one cylinder is shown in FIG. 1), a cylinder head 3, a piston 4 provided in each of the cylinders, a connecting rod 5 connected to the piston 4, a crankshaft 6, a pair of camshafts 7 (intake side and exhaust side), a plurality of cams 8, a plurality of valve lifters 9, a plurality of lower springs 10 and a plurality of intake and exhaust valves 11. As shown in FIG. 1, the cylinder head 3 is disposed on the cylinder block 2. The piston 4 is configured and arranged to reciprocate within the cylinder by explosive combustion. The reciprocating motion of the piston 4 rotates the crankshaft 6 via the connecting rod 5, and the camshafts 7 disposed on the cylinder head 3 are rotated by the rotation of the crankshaft 6.

The cylinder head 3 includes a plurality of lifter guide boss parts 12 integrally formed with the cylinder head 3 in positions corresponding to where the valve lifters 9 are installed. In the first embodiment, each of the valve lifter boss parts 12 preferably defines a pair of lifter bores 12*a*. The structure of the valve lifter boss part 12 will be explained in more detail below. As shown in FIG. 1, the cylinder head 3 also defines a plurality of intake and exhaust ports having valve openings 12*b* for fluidly communicating combustion chambers of the cylinders with the intake and exhaust ports.

Each of the cams 8 is disposed on a corresponding one of the camshafts 7. The cams 8 are configured and arranged to rotate in accordance with the rotation of the camshafts 7. The valve lifters 9 are operatively attached to the cams 8 so that the valve lifters 9 are periodically pushed down by the cams 8. The valve lifters 9 are configured and arranged to slide inside the lifter bores 12*a* formed in the lifter guide boss parts 12. The cams 8 push down on the valve lifters 9 which push down the valves 11 against the force of the lower springs 10 such that the valve openings 12*b* are opened.

Figure 2:
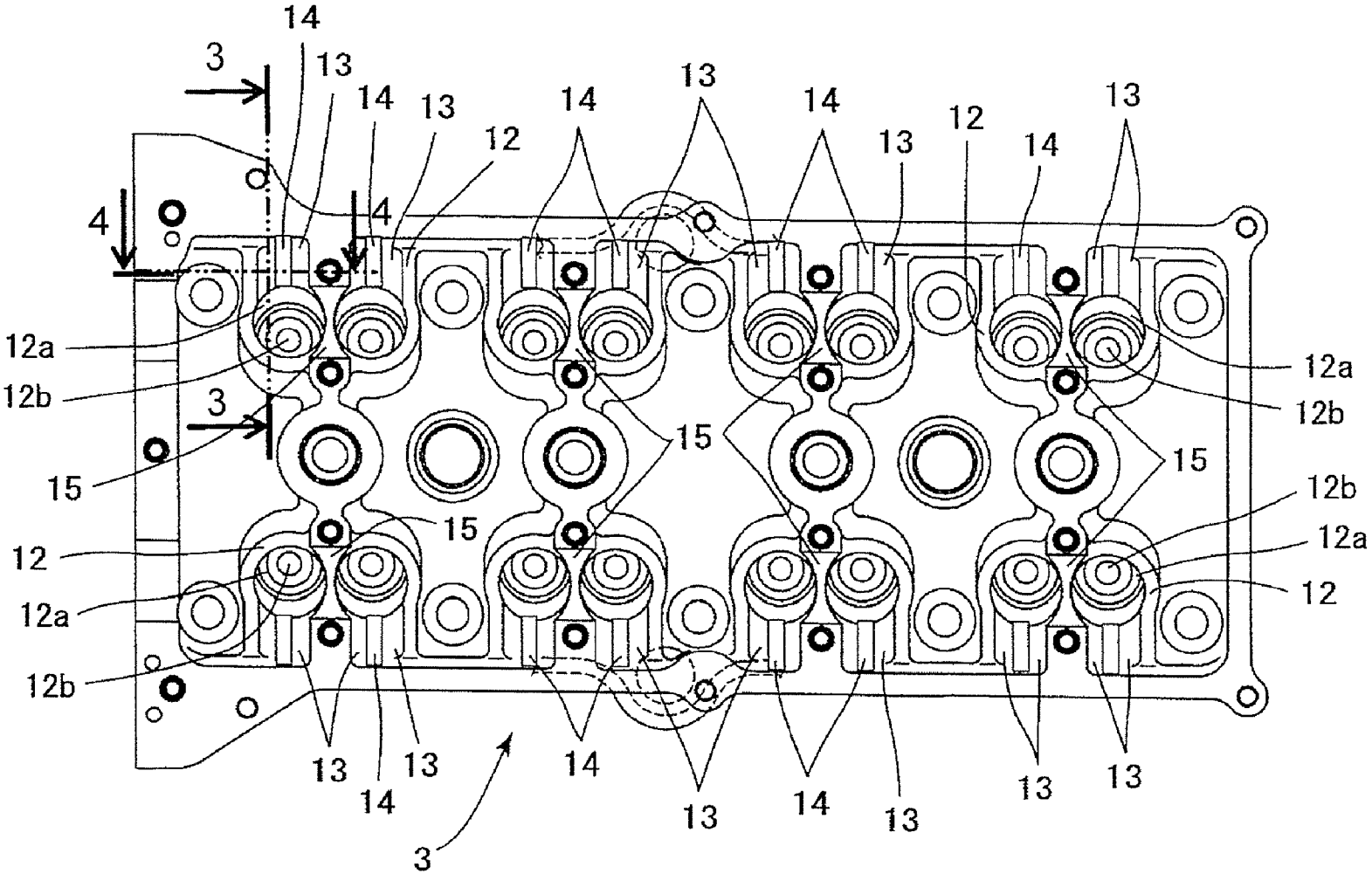
FIG. 2 is a top plan view of a cylinder head of the engine in accordance with the first embodiment of the present invention.

FIG. 2 is a top plan view of the cylinder head 3 in a state where a rocker cover has been removed. The lifter guide boss part 12 is integrally formed on each of an air exhaust side and an air intake side of the cylinder head 3 for each of the four cylinders. The valve lifters 9 are slidably disposed within the lifter bores 12*a* of the lifter guide boss parts 12. Moreover, as shown in FIG. 2, each of the lifter guide boss parts 12 includes a camshaft bearing portion 15 for supporting the corresponding one of the camshafts 7.

Figure 3:
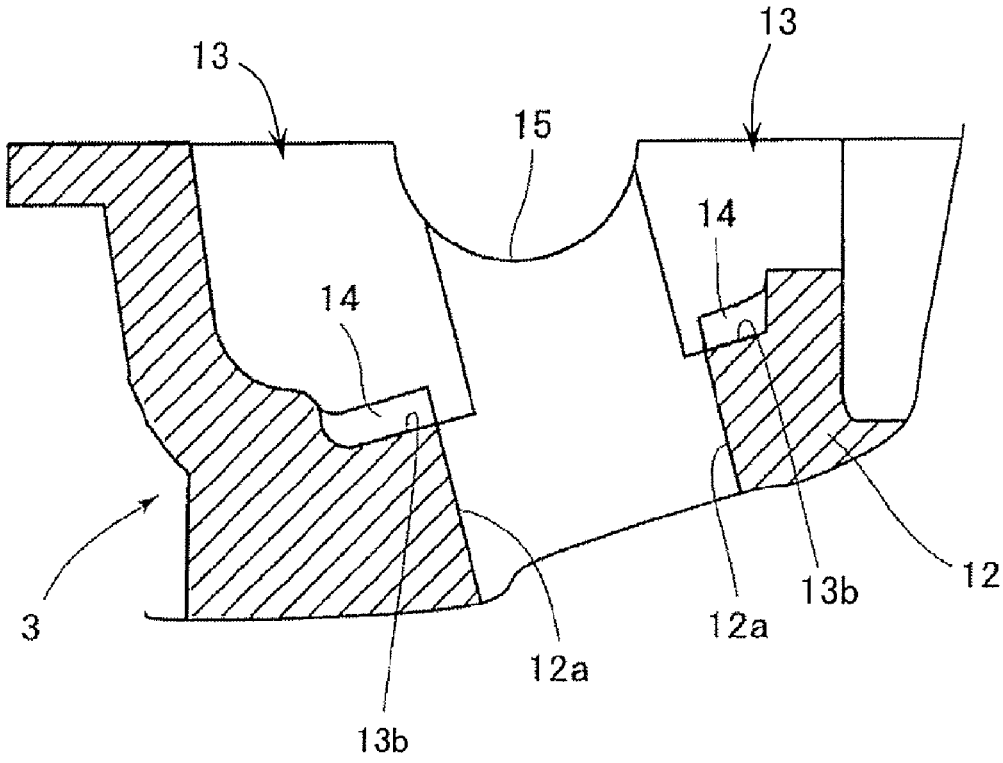
FIG. 3 is an enlarged partial cross sectional view of the cylinder head taken along a section line 2-2 of FIG. 2 in accordance with the first embodiment of the present invention.
Figure 4:
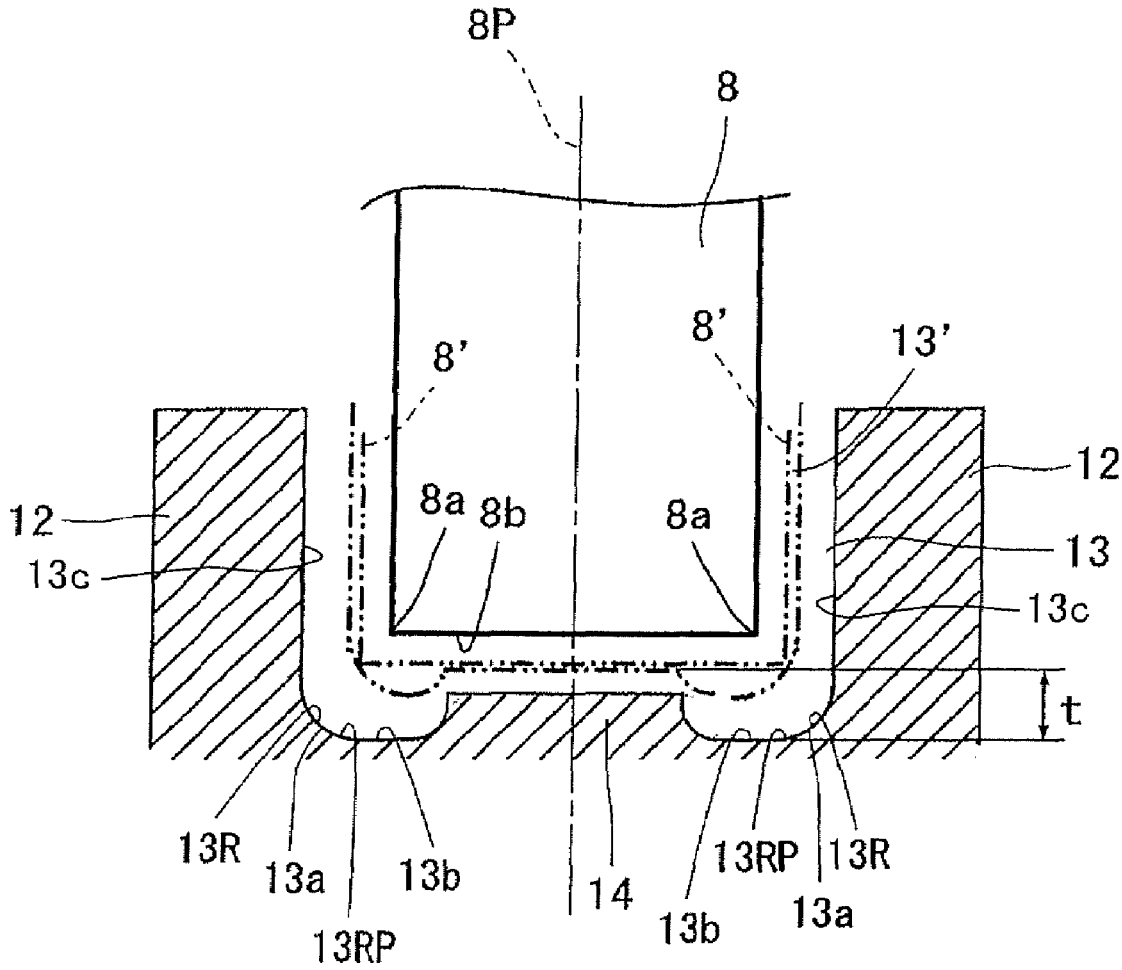
FIG. 4 is an enlarged partial cross sectional view of the cylinder head taken along a section line 4-4 of FIG. 2 shown with a part of a cam in accordance with the first embodiment of the present invention.

As shown in FIG. 2, a relief groove portion 13 is formed in a concave shape in the portions of the lifter guide boss part 12 corresponding to the rotational direction of the cams 8. In other words, as shown in FIGS. 2 to 4, the relief groove portion 13 forms a cut out section on an inner sliding surface in an end portion of the lifter bore 12*a*. Therefore, interference between the cams 8 and the lifter guide boss parts 12 is prevented by providing the relief groove portions 13 in the lifter guide boss parts 12.

FIG. 3 is an enlarged partial cross sectional view of the cylinder head 3 as taken along a section line 3-3 of FIG. 2. As shown in FIG. 3, in the first embodiment, the relief groove portion 13 is preferably formed on both sides of a sliding axis of the valve lifter 9 in the rotational direction of the cam 8. Moreover, a guide portion 14 is integrally formed with the lifter guide boss part 12 at each of the relief groove portions 13. More specifically, the guide portion 14 protrudes upward from a groove bottom surface 13*b* of the relief groove portion 13 to slidably guide the valve lifter 9. The guide portion 14 is arranged such that an inner surface of the guide portion 14 continuously extends from the inner sliding surface of the lifter bore 12*a* as shown in FIG. 3.

FIG. 4 is an enlarged partial cross sectional view of the cylinder head 3 as taken along a section line 4-4 of FIG. 2 shown with a part of the cam 8. As shown in FIG. 4, the guide portion 14 is formed so as to protrude from the groove bottom surface 13*b* of the relief groove portion 13 in a sliding direction of the valve lifter 9 (i.e., a direction parallel to a center axis of the lifter bore 12*a*). The guide portion 14 has a shape that is substantially symmetrical with respect to a centerline 8P of the cam 8 in a width direction or a rotational axis direction (left to right direction in FIG. 4), which is rotated inside the relief groove portion 13.

The relief groove portion 13 includes a pair of corner sections 13*a* in the width direction (left to right direction in FIG. 4) of the relief groove portion 13. In other words, the corner sections 13*a* are formed between groove side surfaces 13*c* and the groove bottom surface 13*b*. Each of the corner sections 13*a* includes a rounded corner surface 13R as shown in FIG. 4. The rounded corner surfaces 13R are provided for preventing stress concentration and/or as a result of manufacturing process of the cylinder head 3. More specifically, each of the rounded corner surfaces 13R continuously extends from a rising position 13RP in the groove bottom surface 13*b* toward the groove side surface 13*c* as shown in FIG. 4 (i.e., the rising position 13RP is a transitional position between the groove bottom surface 13*b* and the rounded corner surface 13R). In the illustrated embodiment, the guide portion 14 protrudes from the groove bottom surface 13*b* such that the guide portion 14 is spaced apart from the rising positions 13RP of the rounded corner surfaces 13R as shown in FIG. 4.

If the guide portion 14 were formed to protrude from the rising positions 13RP of the rounded corner surfaces 13R or from the rounded corner surfaces 13R of the relief groove portion 13, the width of the guide portion 14 could be maximized and the guide portion 14 could stably guide the valve lifter 9. However, in the illustrated embodiment, the guide portion 14 is dimensioned so that rising portions (width direction edges of the guide portion 14) of the guide portion 14 are spaced apart from the rising positions 13RP of the rounded corner surfaces 13R with taking into consideration geometric tolerances such as the width dimension variations in the relief groove portion 13, the dimension variations in the rounded corner surfaces 13R and the width dimension variations in the guide portion 14.

More specifically, the guide portion 14 is formed to protrude at a position sufficiently inward of the rising positions 13RP of the rounded corner surfaces 13R such that cutout portions (incomplete rounded portions) where stress concentration easily occurs are not formed in the corner sections 13*a* even when the dimension variations occur.

In FIG. 4, dimension variations of the cam 8 and the relief groove portion 13 are indicated by imaginary lines (double-dot-chain lines). As shown in FIG. 4, corner portions 8*a* (width direction edges) of the lower end of the cam 8 and the rounded corner surfaces 13R of the relief groove portion 13 become most proximate to each other when the width dimension of the relief groove portion 13, the depth dimension of the relief groove portion 13, the dimension of the rounded corner surfaces 13R, the width dimension of the guide portion 14, the width dimension of the cam 8, and the radial direction dimension of the cam 8 deviate the most in the directions in which the cam 8 and the relief groove portion 13 interfere with each other easily (i.e., the deviated positions shown with the cam 8' and the relief groove portion 13' in FIG. 4). Therefore, in the illustrated embodiment, the clearance between the cam 8 and the relief groove portion 13 is set such that the corner portions 8*a* of the cam 8 and the rounded corner surfaces 13R of the relief groove portion 13 do not interfere with each other even when such dimensional deviations (geometric tolerances) occur in the direction in which the cam 8 and the relief groove portion 13 interfere with each other easily.

More specifically, the clearance between the cam 8 and the relief groove portion 13 is set such that a margin or clearance "t" is ensured between a cam surface 8*b* of the cam 8 and the groove bottom surface 13*b* of the relief groove portion 13 when the corner portions 8*a* of the cam 8 and the rounded corner surfaces 13R of the relief groove portion 13 become most proximate to each other. Moreover, the guide portion 14 is dimensioned with a height according to the clearance "t". In other words, the height of the guide portion 14 is set so as not to interfere with the cam surface 8*b* of the cam 8 even when the dimensions of the cam 8 and the relief groove portion 13 vary to a maximum extent in the direction in which the cam 8 and the relief groove portion 13 interfere with each other easily due to geometric tolerances in manufacturing.

Figure 5:
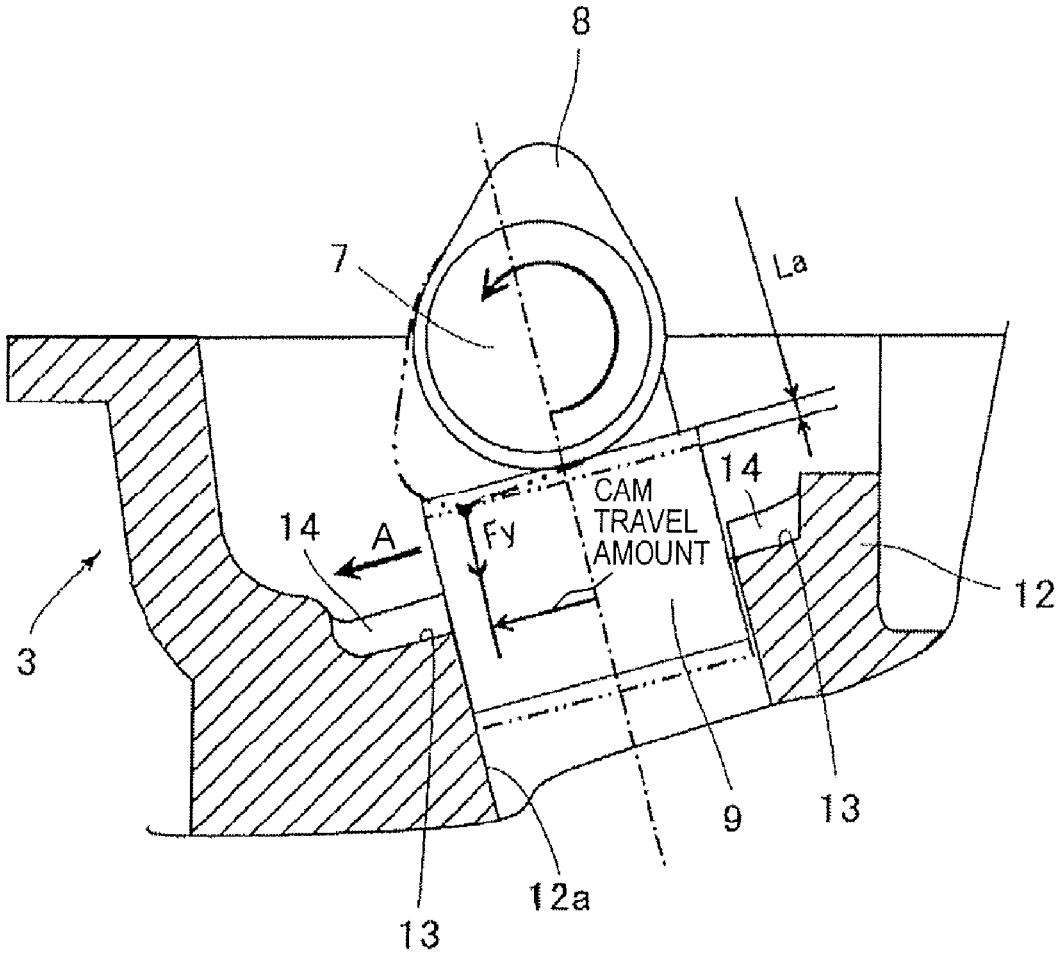
FIG. 5 is an enlarged partial cross sectional view of the cylinder head shown with a valve lifter and the cam for explaining an operation when the valve lifter is pushed down by the rotation of the cam and slides inside a lifter bore formed in the cylinder head in accordance with the first embodiment of the present invention.
Figure 6:
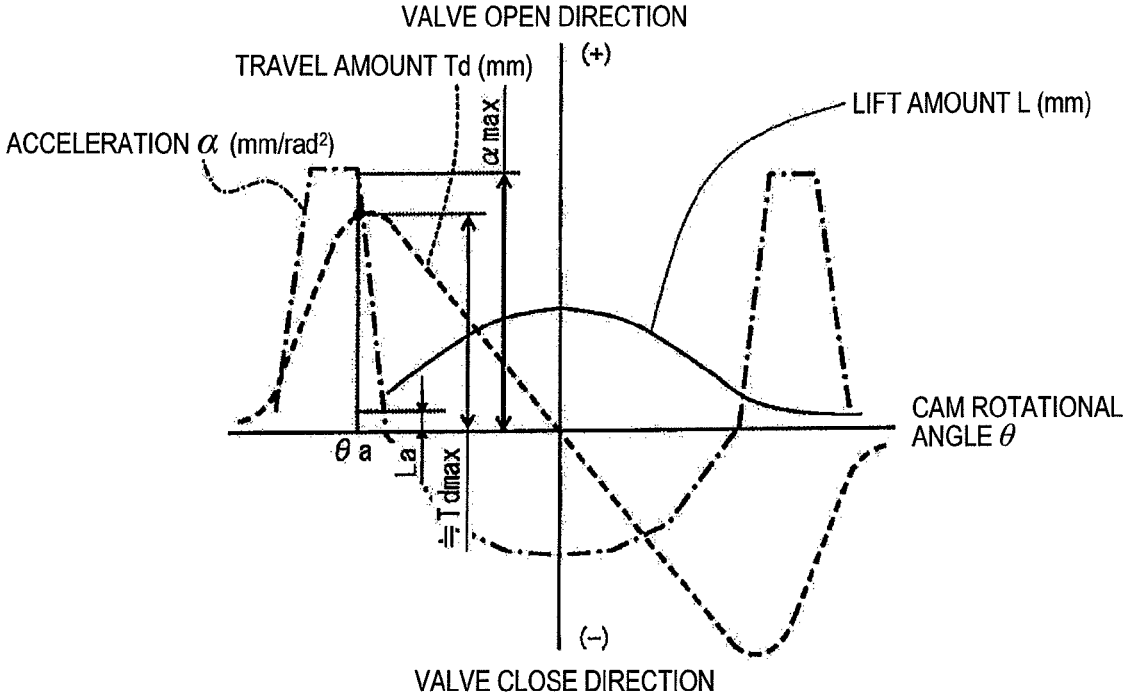
FIG. 6 is a diagram showing the relationship between a rotational angle of the cam, a travel amount of the cam (distance from a sliding axis centerline of the valve lifter to a contact portion between the cam and the valve lifter), an acceleration of the valve lifter, and a stroke amount (lift amount) of the valve lifter in accordance with the first embodiment of the present invention.

FIG. 5 is an enlarged partial cross sectional view of the cylinder head shown with the valve lifter 9 and the cam 8 for explaining an operation when the valve lifter 9 is pushed down by the rotation of the cam 8 and slides inside the lifter bore 12*a* formed in the lifter guide boss part 12. FIG. 6 is a relationship diagram showing the relationship between a rotational angle θ of the cam 8, a travel amount Td of the cam 8 (distance from the sliding axis center of the valve lifter 9 to a contact portion between the cam 8 and the valve lifter 9), an acceleration α of the valve lifter 9, and a stroke amount (lift amount L) of the valve lifter 9.

As shown in FIGS. 5 and 6, the valve lifter 9 is pushed down by the rotation of the cam 8 and begins moving downward. At this time, a force Fy (force in the sliding axis direction of the valve lifter 9) for pushing down the valve lifter 9 acts on the contact portion where the valve lifter 9 contacts the cam 8. The magnitude of this force Fy is determined by the product of an inertial mass m of each part of the valve operating system, such as the cam 8 and the valve lifter 9, and the acceleration α of the valve lifter 9.

When the rotational angle θ of the cam 8 becomes a value θa as shown in FIG. 6 and the travel amount Td reaches the vicinity of a maximum value Tdmax, the acceleration α of the valve lifter 9 becomes a maximum value αmax. Thus, the force Fy also becomes a maximum value Fymax. Moreover, the travel amount Td that is the distance from the sliding axis center of the valve lifter 9 to the contact portion between the cam 8 and the valve lifter 9 becomes a value close to the maximum value Tdmax. Therefore, the rotational moment for toppling the valve lifter 9 in the direction of an arrow A in FIG. 5 also becomes a value close to a maximum value. On the other hand, at this time, the lift amount L of the valve lifter 9 is a relatively small value La as shown in FIG. 6. Therefore, when the rotational angle θ of the cam 8 becomes the value θa, the valve lifter 9 tends to easily topple in the direction of the arrow A in FIG. 5. However, in the illustrated embodiment, the guide portion 14 is formed in the direction of the arrow A in FIG. 5 to protrude from the groove bottom surface 13*b* to restrict the toppling of the valve lifter 9 and to stably and slidably guide the valve lifter 9. Thus, the cylinder head 3 of the illustrated embodiment provided with the guide portion 14 can also reduce noise resulting from a valve lifter hitting (rattling) sound. Moreover, simply by forming the guide portion 14 to protrude from the groove bottom surface 13*b* of the relief groove portion 13, the valve lifter 9 can be stably guided by the guide portion 14 while sufficiently ensuring a clearance between the rounded corner surfaces 13R of the relief groove portion 13 and the corner portions 8*a* of the cam 8 where sensitivity becomes the highest in interference between the cam 8 and the lifter guide boss part 12. Accordingly, the stability of the sliding orientation of the valve lifter 9 can be easily ensured.

Furthermore, the guide portion 14 is formed in a shape that is substantially symmetrical with respect to the width direction centerline 8P of the cam 8 that is rotated inside the relief groove portion 13. Moreover, the guide portion 14 is dimensioned such that the width of the guide portion 14 is ensured to the maximum extent possible as long as the rising portions of the guide portion 14 are spaced apart from the rising positions 13RP of the rounded corner surfaces 13R taking into consideration the width dimension variations in the relief groove portion 13, the dimension variations in the rounded corner surfaces 13R of the corner portions 13*a* and the width dimension variations in the guide portion 14. Therefore, a cutout portion (incomplete rounded portion) where stress concentration easily occurs is prevented from being formed in the corner sections 13*a* of the relief groove portion 13 and the sliding orientation of the valve lifter 9 can be made even more stable.

SECOND EMBODIMENT

Figure 7:
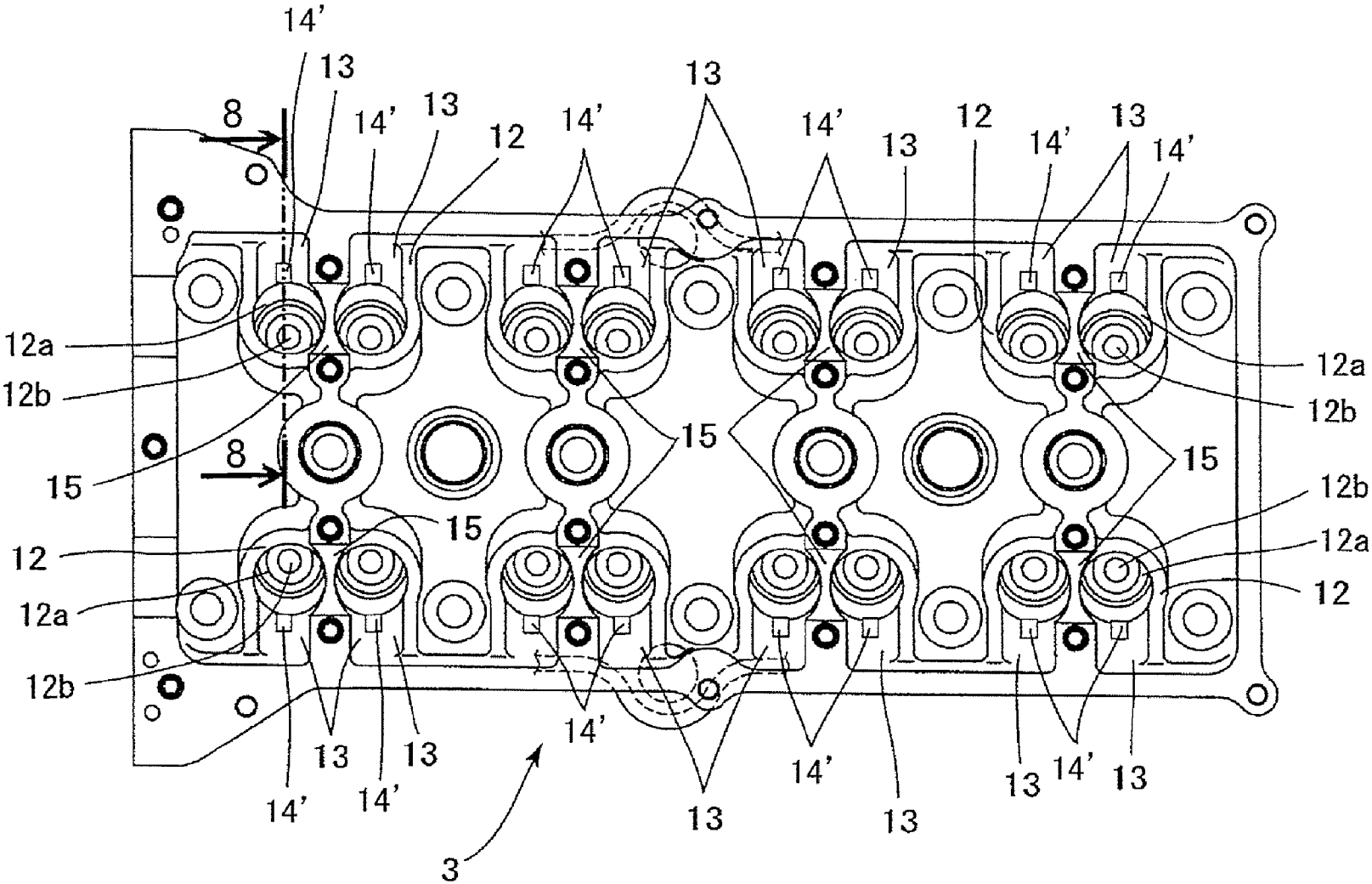
FIG. 7 is a top plan view of a cylinder head of an internal combustion engine in accordance with a second embodiment of the present invention.
Figure 8:
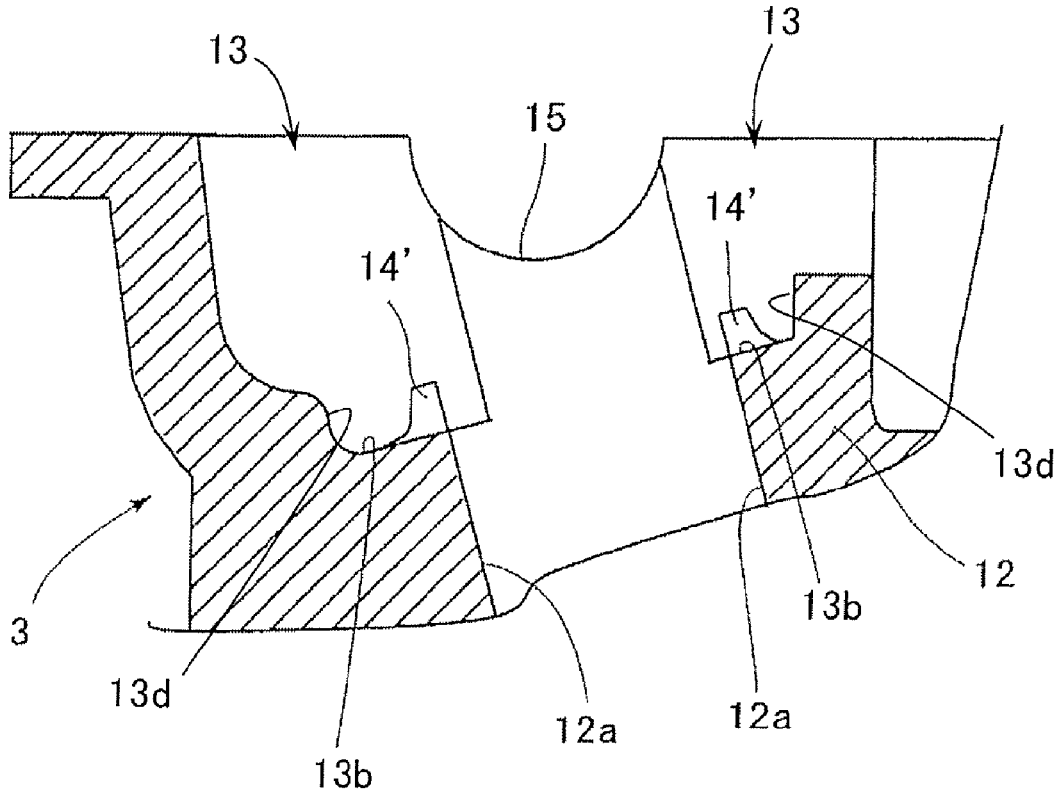
FIG. 8 is an enlarged partial cross sectional view of the cylinder head taken along a section line 8-8 of FIG. 7.

Referring now to FIGS. 7 and 8, an internal combustion engine in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

FIG. 7 is a top plan view of a cylinder head 3 of the engine 1 (shown in FIG. 1) in accordance with a second embodiment. FIG. 8 is an enlarged partial cross sectional view of the cylinder head 3 taken along a section line 8-8 of FIG. 7. The second embodiment is identical to the first embodiment except for a structure of a guide portion 14' formed in the lifter guide boss part 12. More specifically, in the second embodiment, the length of the guide portion 14' in the rotational direction of the cam 8 is made shorter as compared to the guide portion 14 of the first embodiment. In other words, the guide portion 14' of the second embodiment is spaced apart from a circumferential surface 13*d* of the relief groove part 13 as shown in FIG. 8. Similarly to the first embodiment, the guide portion 14' of the second embodiment is integrally formed with the lifter guide boss part 12 to protrude from the groove bottom surface 13*b* of the relief groove portion 13. The cylinder head 3 can be made lightweight by the amount that the guide portion 14' has been shortened as compared to the first embodiment, as long as the strength of the guide portion 14 is ensured.

The width direction dimension of the guide portion 14' is set to the maximum extent possible while sufficiently ensuring the distance between the corner sections 13*a* of the relief groove portion 13 and the cam 8. Thus, the valve lifter 9 is readily and slidably guided by the guide portion 14'. Accordingly, the sliding orientation of the valve lifter 9 can be stabilized.

In the first and second embodiments described above, the guide portions 14 and 14' are integrally formed to protrude from the groove bottom surface 13*b* of the relief groove portion 13. However, the present invention is not limited to such arrangements. For example, the guide portion 14 or 14' can also be formed separately from the groove bottom surface 13*b* of the relief groove portion 13 and fixed to the groove bottom surface 13*b* by welding or the like.

In the first and second embodiments described above, the guide portion 14 and 14' are formed in a shape that is substantially symmetrical with respect to the width direction centerline 8P of the cam 8 that is rotated inside the relief groove portion 13. However, the present invention is not limited to such arrangements. For example, the guide portion 14 or 14' can also have a shape that is not substantially symmetrical with respect to the width direction centerline 8P.

In the first and second embodiments described above, the guide portions 14 and 14' are formed in both of the relief groove portions 13 formed on both sides of the sliding axis of the valve lifter 9 in the rotational direction of the cam 8. However, the present invention is not limited to such arrangements. For example, the guide portion 14 or 14' can also be formed only in the relief groove portion 13 that the cam 8 enters by rotation.

According to the illustrated embodiments, by simply forming the guide portion 14 or 14' to protrude from the groove bottom surface 13*b* of the relief groove portion 13 such that the guide portion 14 or 14' is spaced apart from the corner section 13*a* of the relief groove portion 13, the valve lifter 9 can be stably guided by the guide portion 14 while sufficiently ensuring a distance between the cam 8 and the corner section 13*a* of the relief groove portion 13 in which the rounded corner surface 13R or the like is usually provided for avoiding stress concentration and in which the sensitivity becomes the highest in interference with an object (e.g., the cam 8). Therefore, the stability of the sliding orientation of the valve lifter 9 can be easily ensured.

Moreover, the guide portion 14 or 14' is integrally formed to protrude from the groove bottom surface 13*b* of the relief groove portion 13. Therefore, an increase in the number of parts can be controlled. Thus, the stability of the sliding orientation of the valve lifter 9 can be ensured while controlling an increase in cost.

Furthermore, the guide portion 14 or 14' is formed in a shape that is substantially symmetrical with respect to the width direction centerline 8P of the cam 8. Therefore, the sliding orientation of the valve lifter 9 can be made even more stable.

Moreover, the rounded corner surface 13R is provided in the corner section 13*a* of the relief groove portion 13, and the guide portion 14 or 14' is spaced apart from the rising position 13RP of the rounded corner surface 13R in the groove bottom surface 13*b* of the relief groove portion 13 taking into consideration geometric tolerance. Therefore, the width of the guide portion 14 or 14' can be ensured to the maximum extent possible while a cutout portion (incomplete rounded portion) where stress concentration easily occurs can be prevented from being formed in the corner section 13*a*. Thus, the sliding orientation of the valve lifter 9 can be made even more stable.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A cylinder head comprising:

a lifter guide boss part defining a lifter bore configured and arranged to slidably support a valve lifter that is periodically pushed down by a cam that rotates in accordance with a rotation of a camshaft;

a concave relief groove portion having a predetermined width and a predetermined depth formed on the lifter guide boss part in a position corresponding to a rotation direction of the cam to avoid an interference between the cam and the lifter guide boss part due to a rotation of the cam, the relief groove portion including a pair of groove side surfaces extending substantially parallel to a rotation plane of the cam and a groove bottom surface extending between the groove side surfaces with a pair of corner sections being formed between the groove bottom surface and the groove side surfaces; and a guide portion protruding from the groove bottom surface of the relief groove portion in a sliding direction of the valve lifter to slidably guide the valve lifter, the guide portion being spaced apart from the corner sections of the relief groove portion.

2. The cylinder head as recited in claim 1, wherein the guide portion is integrally formed with the relief groove portion.

3. The cylinder head as recited in claim 1, wherein the guide portion is arranged to be substantially symmetrical with respect to a width direction centerline of the cam when the cam is installed in the cylinder head.

4. The cylinder head as recited in claim 1, wherein at least one of the corner sections of the relief groove portion includes a rounded corner surface continuously extending from a rising position in the groove bottom surface towards the groove side surface, and the guide portion is spaced apart from the rising position in the groove bottom surface of the relief groove portion taking geometric tolerance into consideration.

5. The cylinder head as recited in claim 2, wherein the guide portion is arranged to be substantially symmetrical with respect to a width direction centerline of the cam when the cam is installed in the cylinder head.

6. The cylinder head as recited in claim 2, wherein at least one of the corner sections of the relief groove portion includes a rounded corner surface continuously extending from a rising position in the groove bottom surface towards the groove side surface, and the guide portion is spaced apart from the rising position in the groove bottom surface of the relief groove portion taking geometric tolerance into consideration.

7. The cylinder head as recited in claim 5, wherein at least one of the corner sections of the relief groove portion includes a rounded corner surface continuously extending from a rising position in the groove bottom surface towards the groove side surface, and the guide portion is spaced apart from the rising position in the groove bottom surface of the relief groove portion taking geometric tolerance into consideration.

8. An internal combustion engine comprising:

a camshaft configured and arranged to rotate in accordance with a rotation of a crankshaft;

a cam coupled to the camshaft to rotate in accordance with the rotation of the camshaft;

a valve lifter operatively coupled to the cam such that the valve lifter is periodically pushed down by the cam as the cam rotates; and a cylinder head rotatably supporting the camshaft and the cam, the cylinder head including a lifter guide boss part defining a lifter bore that slidably supports the valve lifter, a concave relief groove portion having a predetermined width and a predetermined depth formed on the lifter guide boss part in a position corresponding to a rotation direction of the cam to avoid an interference between the cam and the lifter guide boss part due to a rotation of the cam, the relief groove portion including a pair of groove side surfaces extending substantially parallel to a rotation plane of the cam and a groove bottom surface extending between the groove side surfaces with a pair of corner sections being formed between the groove bottom surface and the groove side surfaces, and a guide portion protruding from the groove bottom surface of the relief groove portion in a sliding direction of the valve lifter to slidably guide the valve lifter, the guide portion being spaced apart from the corner sections of the relief groove portion.

9. The cylinder head as recited in claim 1, wherein the lifter guide boss part includes a sliding surface defining the lifter bore to slidably support the valve lifter, and the concave relief groove portion forms a cut out section on the sliding surface in an end portion of the lifter bore.

10. The cylinder head as recited in claim 9, wherein the guide portion includes an inner surface continuously extending from the sliding surface of the lifter guide boss part.

11. The internal combustion engine as recited in claim 8, wherein the lifter guide boss part of the cylinder head includes a sliding surface defining the lifter bore to slidably support the valve lifter, and the concave relief groove portion of the cylinder head forms a cut out section on the sliding surface in an end portion of the lifter bore.

12. The internal combustion engine as recited in claim 11, wherein the guide portion of the cylinder head includes an inner surface continuously extending from the sliding surface of the lifter guide boss part.

* * * * *